US005658862A

United States Patent [19]

Vrahopoulou

[11] Patent Number: 5,658,862

[45] Date of Patent: Aug. 19, 1997

[54] ENGINE OIL WITH IMPROVED FUEL ECONOMY PROPERTIES (LAW372).

[75] Inventor: Elisavet P. Vrahopoulou, Chatham, N.J.

[73] Assignee: Exxon Research and Engineering Company, Florham Park, N.J.

[21] Appl. No.: 589,176

[22] Filed: Jan. 19, 1996

Related U.S. Application Data

[63] Continuation-in-part of Ser. No. 359,793, Dec. 20, 1994, abandoned, and a continuation-in-part of Ser. No. 359,794, Dec. 20, 1994, abandoned.

[51] Int. Cl.[6] ..... C10M 141/08; C10M 141/10; C10M 141/12; C10M 163/00

[52] U.S. Cl. ..... 508/192; 508/365; 508/379; 508/536; 508/591

[58] Field of Search ..... 252/49.6, 32.7, 252/39, 33.6, 51.5 A; 508/192, 365, 379, 536, 591

[56] References Cited

U.S. PATENT DOCUMENTS

| | | | |
|---|---|---|---|
| 3,087,936 | 4/1963 | LeSuer | 252/49.6 |
| 3,254,025 | 5/1966 | LeSuer | 252/49.6 |
| 4,428,849 | 1/1984 | Wisotsky | 252/51.5 A |
| 4,517,104 | 5/1985 | Bloch et al. | 252/51.5 |
| 4,529,526 | 7/1985 | Inoue et al. | 252/32.7 |
| 4,767,551 | 8/1988 | Hunt et al. | 252/32.7 E |
| 4,776,967 | 10/1988 | Ichihashi et al. | 252/32.7 |
| 4,801,390 | 1/1989 | Robson | 252/25 |
| 4,804,794 | 2/1989 | Ver Strate et al. | 585/12 |
| 4,863,624 | 9/1989 | Emert et al. | 252/51.5 |
| 5,114,602 | 5/1992 | Petrille et al. | 252/51.5 |
| 5,312,556 | 5/1994 | Chung et al. | 252/51.5 |
| 5,356,547 | 10/1994 | Arai et al. | 252/46.4 |

FOREIGN PATENT DOCUMENTS

| | | |
|---|---|---|
| 0562172 | 9/1993 | European Pat. Off. . |

*Primary Examiner*—Margaret Medley
*Attorney, Agent, or Firm*—Roy J. Ott

[57] ABSTRACT

A lubricating oil composition having improved fuel economy and fuel economy retention property which comprises a lubricating oil basestock, a boron containing alkenyl succinimide, molybdenum, di-thiocarbamate and/or molybdenum dithiophosphate, calcium and magnesium salicylate, and ethylene copolymer.

9 Claims, No Drawings

ENGINE OIL WITH IMPROVED FUEL ECONOMY PROPERTIES (LAW372).

CROSS REFERENCE TO RELATED APPLICATIONS

This is a continuation-in-part application of U.S. patent application Ser. No. 08/359,793, filed Dec. 20, 1994 and U.S. patent application Ser. No. 08/359,794, filed Dec. 20, 1994 both now abandoned.

BACKGROUND OF THE INVENTION

1. Field Of The Invention

This invention relates to an engine oil having improved fuel economy properties.

2. Description Of The Related Art

The goal of increasing gasoline mileage of automobiles under the Federal Corporate Average Fuel Economy (CAFE) standards has resulted in increased interest in improving the fuel economy performance of engine oils. Increasing the fuel economy performance of engine oils has resulted in greater emphasis on friction modifiers.

While the majority of moving parts in an internal combustion engine are in a state of hydrodynamic lubrication, some sliding parts such as pistons and valve trains are in a boundary lubrication state. In order to provide wear resistance caused by friction in the boundary lubrication state, it is necessary to provide the engine oil with additives to reduce wear. For many years, zinc dialkyldithiophosphates ("ZDDP") have been a standard antiwear additive. While ZDDP is a good antiwear agent, it has negative impacts on fuel economy. Thus it is usually necessary to include a friction modifier for fuel economy purposes. Both antiwear and friction modifiers function through adsorption on the sliding metal surface and may interfere with each other's respective functions.

U.S. Pat. No. 5,356,547 describes an engine oil having a low coefficient of friction from an early operating stage. European Patent Application 0562172 A1 describes an engine oil having low friction properties from an early operating stage and continuing under longer periods of use.

European published application EP 0562172 describes an engine oil having low friction properties and containing a boron derivative of an alkenylsuccinimide, an alkaline earth metal salt of salicylic acid and a molybdenum dithiophosphate or dithiocarbamate.

It would be desirable to have an engine oil with improved fuel economy and fuel economy retention properties.

SUMMARY OF THE INVENTION

This invention relates to an engine oil for an internal combustion engine having improved fuel economy and fuel economy retention properties which comprises:

(a) an oil base stock, (b) at least 2 wt %, based on engine oil, of a boron containing alkenyl succinimide, with the proviso that the boron concentration in the engine oil is greater than about 800 ppmw, based on engine oil, (c) from 50 to 2000 ppmw, based on engine oil, of molybdenum atoms present as molybdenum dithiophosphate or molybdenum dithiocarbamate, (d) from 50 to 4000 ppmw, based on engine oil, of calcium atoms present as calcium salicylate, (e) from 50 to 4000 ppmw, based on engine oil, of magnesium atoms present as magnesium salicylate, and (f) from 0 to 15 wt %, preferably 0.5 to 15 wt %, based on engine oil, of a copolymer of ethylene and at least one other alpha-olefin monomer, wherein said copolymer has a molecular weight distribution characterized by at least one of a ratio of $M_w/M_n$ of less than 2 and a ratio of $M_z/M_w$ of less than 1.8, and wherein the copolymer comprises intramolecularly heterogeneous polymeric chains containing at least one crystallizable segment of methylene units and at least one low crystallinity ethylene-alpha-olefin copolymer segment, wherein the crystallizable segment comprises at least about 10 wt % of the copolymer chain and contains as average ethylene content of at least about 57 wt %, wherein the low crystallinity segment contains an average ethylene content of from about 20 to 53 wt %, and wherein at least two portions of an individual intramolecularly heterogeneous chain, each portion comprising at least 5 wt % of said chain, differ in composition from one another by at least 7 wt % ethylene.

In another embodiment, there is provided a method for improving the fuel economy and fuel retention performance of an internal combustion engine which comprises operation the engine with the engine oil described above.

DETAIL DESCRIPTION OF THE INVENTION

The engine oil according to the invention requires a major amount of lubricating oil basestock.

The lubricating oil basestock can be derived from natural lubricating oils, synthetic lubricating oils, or mixtures thereof. Suitable lubricating oil basestocks include basestocks obtained by isomerization of synthetic wax and slack wax, as well as hydrocrackate basestocks produced by hydrocracking (rather than solvent extracting) the aromatic and polar components of the crude. In general, the lubricating oil basestock will have a kinematic viscosity ranging from about 2 to about 1,000 cSt at 40° C.

Natural lubricating oils include animal oils, vegetable oils (e.g., castor oils and lard oil), petroleum oils, mineral oils, and oils derived from coal or shale.

Synthetic oils include hydrocarbon oils and halo-substituted hydrocarbon oils such as polymerized and interpolymerized olefins, alkylbenzenes, polyphenyls, alkylated diphenyl ethers, alkylated diphenyl ethers, alkylated diphenyl sulfides, as well as their derivatives, analogs, and homologs thereof, and the like. Synthetic lubricating oils also include alkylene oxide polymers, interpolymers, copolymers and derivatives thereof wherein the terminal hydroxyl groups have been modified by esterification, etherification, etc. copolymers and derivatives thereof wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from $C_5$ to $C_{12}$ monocarboxylic acids and polyols and polyol ethers.

Silicon-based oils (such as the polyakyl-, polyaryl-, polyalkoxy-, or polyaryloxy-siloxane oils and silicate oils) comprise another useful class of synthetic lubricating oils. Other synthetic lubricating oils include liquid esters of phosphorus-containing acids, polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

Molybdenum dithiocarbamates and molybdenum dithiophosphates, which function as friction modifiers are preferably molybdenum di-thiocarbamates. Examples of molybdenum dithiocarbamates include $C_6$–$C_{18}$ dialkyl or diaryl dithiocarbamates such as molybdenum dibutyl-, diamyl-, di(2-ethylhexyl)-, dilauryl-, dioleyl- and dicyclohexyldithiocarbamate. The amount of molybdenum in the engine oil in terms of molybdenum atoms is from 50 to 2000 ppm, preferably 100 to 1000 ppm. These molybdenum compounds are commercially available.

Borated dispersants are described in U.S. Pat. No. 4,863,624. Preferred borated dispersants are boron derivatives derived from polyisobutylene substituted with succinic anhydride groups and reacted with polyethylene amines, polyoxyethylene amines, and polyol amines (PIBSA/PAM) and are preferably added in an amount from 2 to 16 wt %, based on oil composition. These reaction products are amides, imides or mixtures thereof. The borated dispersants are "over-borated", i.e., they contain boron in an amount from 0.5 to 5.0 wt % based on dispersants. These over-borated dispersants are available from Exxon Chemical Company. In addition to borated dispersants, other sources of boron which may contribute to the total boron concentration include borated dispersant VI improvers and borated detergents.

The amount of boron in the engine oil should be at least about 800 ppmw, preferably 900 to 2000 ppmw. Typical commercial engine oils which contain borated dispersants have boron concentrations in the range of 30 to 400 ppw. It is known that dispersant additives affect the viscosity characteristics of multigrade engine oils. The primary function of a dispersant is to maintain oil insolubles resulting from oxidative degradation of oils in oil suspension. This helps control sludge formation. Conventional dispersants, because they are less shear sensitive, also impact the low temperature properties by causing an increase in low temperature viscosity. However they have a much less effect on high temperature viscosity. The presence of boron in the dispersant helps wear control and elastomer performance. It is preferred to use over-borated dispersants since this permits higher concentrations of boron at equivalent concentration of dispersant with minimum increase in the low temperature viscosity.

The present engine oil includes a synergistic combination of calcium and magnesium salicylates as detergents. It has been discovered that the synergistic combination of detergents works better than either one alone. Preferred concentration of calcium and magnesium atoms present as calcium salicylate and magnesium salicylate, respectively, are from 100 to 3000 ppmw, based on engine oil. In a more preferred embodiment, the weight ratio of calcium atoms to magnesium atoms present in the synergistic combination of calcium and magnesium salicylates is in the range of 8/1 to 1/8. While detergents are normally added to engine oils for purposes of engine cleanliness and neutralizing acidic species, the subject salicylate detergents in combination with molybdenum dithiophosphates and/or molybdenum dithiocarbamates and over-borated alkenyl succimides result in better fuel economy and fuel economy retention properties for the engine oil. Salicylate detergents are superior to the equivalent sulfonate detergents for fuel economy and fuel economy retention purposes.

The viscosity index (VI) improvers are described in U.S. Pat. No. 4,804,794 and are commercially available from Exxon Chemical Company. These VI improvers are segmented copolymers of ethylene and at least one other alpha-olefin monomer; each copolymer is intramolecularly heterogeneous and intermolecularly homogeneous and at least one segment of the copolymer, constituting at least 10% of the copolymer's chain, is a crystallizable segment. The term "crystallizable segment" is defined to be each segment of the copolymer chain having a number-average molecular weight of at least 700 wherein the ethylene content is at least 55 wt % preferably at least 57 wt %. The remaining segments of the copolymer chain are herein termed the "low crystallinity segments" and are characterized by an average ethylene content of not greater than about 53 wt %, preferably 20 to 53 wt %. Furthermore, the molecular weight distribution or MWD of copolymer is very narrow. It is well known that the breadth of the MWD can be characterized by the ratios of various molecular weight averages. For example, an indication of a narrow MWD is that the ratio of weight to number-average molecular weight ($M_w/M_n$) is less than 2, preferably less than 1.5. Alternatively, a ratio of the z-average molecular weight to the weight-average molecular weight ($M_z/M_w$) of less than 1.8, preferably less than 1.5 typifies a narrow MWD. It is known that a portion of the property advantages of copolymers are related to these ratios. Small weight fractions of material can disproportionately influence these ratios while not significantly altering the property advantages which depend on them. For instance the presence of a small weight fraction (e.g., 2%) of low molecular weight copolymer can depress $M_n$, and thereby raise $M_w/M_n$ above 2 while maintaining $M_z/M_n$ less than 1.8. Therefore, the present polymers are characterized by having at least one of $M_w/M_n$ less than 2 and $M_z/M_w$ less than 1.8. The copolymer comprises chains within which the ratio of the monomers varies along the chain length.

The copolymer has an intermolecular compositional dispersity such that 45 wt % of the copolymer chains have an ethylene composition that differs from the average weight percent ethylene composition by 15 wt % or less, preferably 10 wt % or less. The copolymer weight average molecular weight is from 20,000 to 1,000,000, preferably 50,000 to 500,000.

To obtain the intramolecular compositional heterogeneity and narrow MWD, the copolymers are preferably made in a tubular reactor. When produced in a tubular reactor with monomer feed only at the tube inlet ethylene, due to its high reactivity, will be preferentially polymerized at the beginning of the tubular reactor. The concentration of monomers in solution changes along the tube in favor of propylene as the ethylene is depleted. The result, with monomer feed only at the inlet, is copolymer chains which are higher in ethylene concentration in the chain segments grown near the reactor inlet (as defined at the point at which the polymerization reaction commences), and higher in propylene concentration in the chain segments formed near the reactor outlet. These copolymer chains are therefore tapered in composition.

Conventional engine oils may contain other additives well known in the art. Such additives include other friction modifiers, other dispersants, antioxidants, rust and corrosion inhibitors, other detergents, pour point depressants, viscosity index improvers, anti-wear agents, antifoam agents, demulsifier, hydrolytic stabilizers and extreme pressure agents. Such additives are described in "Lubricants and Related Products" by Dieter Klamann, Verlag Chemie, Weinheim, Germany, 1984. The engine oils can be used in essentially any internal combustion engine.

The invention may be further understood by reference to the following examples which include a preferred embodiment.

EXAMPLE 1, COMPARATIVE EXAMPLE 2, EXAMPLE 3 AND COMPARATIVE EXAMPLE 4

This example illustrates the effect of a combination of Ca and Mg salicylates on fuel economy performance of an engine oil verses Ca salicylate alone and also the effect of boron concentration. ASTM Sequence VI and Sequence VI Screener Tests are described as follows.

The ASTM Sequence VI test procedure (SAE JI 423 May 1988) is used for evaluating engine oils and for identifying energy conserving engine oils for passenger cars, vans, and light duty trucks. The recommenced practice involves a classification for engine oils that have energy-conserving characteristics under certain operating conditions and are categorized as "Energy Conserving" (tier I) or "Energy Conserving II" (tier II). In accordance with the definitions set forth in the Sequence VI test procedure, Energy Conserving (tier I) and Energy Conserving II (tier II) engine oils are lubricants that demonstrate reduced fuel consumption when compared to specified ASTM reference oils using a procedure which is described in ASTM Research Report No. RR:PD02:1204, "Fuel Efficient Engine Oil Dynamometer Test Development Activities, Final Report, Part II, August 1985."

The Sequence VI procedure compares fuel consumption with a candidate oil to that with the ASTM HR (High Reference) SAE 20W-30 Newtonian oil in terms of Equivalent Fuel Economy Improvement (EFEI) by use of the following equation:

$$EFEI = \frac{[0.65\ (\text{Stage } 150) + 0.35(\text{Stage } 275) - 0.61]}{1.38} \quad (1)$$

The equation is used to transfer the data obtained in two stages of an older procedure, known as the five-car procedure (published as D-2 Proposal P101 in Volume 05.03 of the 1986 ASTM Book of Standards), which is an alternative method only for use in evaluating engine oils that meet the Energy Conserving (tier I) category. To fulfill the Tier I energy-conserving requirement using the five-car procedure, the candidate oil must meet the performance limits of the classification published as a proposal in Volume 05.03 of the ASTM Book of Standards (D-2 Proposal P102). The five-car average fuel consumption with the candidate oil must be less than that with reference oil HR by at least 1% and the minimum lower 95% confidence level (LCL95) must be at least 0.3%. When using reference oil HR-2, the average fuel consumption with the candidate oil must be at least 1.5% less than that with reference oil with a minimum LCL95.

When the Sequence VI test is used, the results obtained in two of the stages of the test are transformed to an equivalent five-car percent improvement by use of the above equation.

The Equivalent Fuel Economy improvement (EFEI) from the Sequence VI test must meet the limits of the aforementioned classification D-2 Proposal P102, with the exception of the LCL95 requirement which applies to only the five-car procedure. For a candidate oil to be categorized as Energy Conserving II the Equivalent Fuel Economy Improvement (EFEI) as described above and must be a minimum of 2.7% when compared to HR-2.

Thus Engine oils categorized as "Energy Conserving (tier I) are formulated to improve the fuel economy of passenger cars, vans and light-duty trucks by an EFEI of 1.5% or greater over a standard reference oil in a standard test procedure, whereas oils categorized as "Energy Conserving II" (tier II) are formulated to improve the fuel economy of passenger cars, and vans and light-duty trucks by an EFEI of 2.7% or greater over a standard reference oil in a standard test procedures.

Variability problems with batches 6 and 7 of HR oil led to a revised equation by the industry for calculating EFEI in 1991. This is called "Method 2" and is given by the following equation:

$$\underset{\text{(Method 2)}}{EFEI} = \frac{0.66\ (\text{Cand. } \delta 150{:}150) + 0.34 \times (\text{Cand. } \delta 275{:}150) - 0.34 \times (FM\ \delta 275{:}150) + 2.76}{1.45} \quad (2)$$

where:

Cand. δ150:150 is the % difference in BSFC between the HR oil and the candidate oil, both measured at 150° F.

Cand. δ275:150 is the % difference in BSFC between the HR oil measured at 150° F. and the candidate oil measured at 275° F.

FM δ275:150 is the % difference in BSFC between the HR oil measured at 150° F. and the FM oil measured at 275° F.

Fuel economy data reported in the examples to follow are based either on the Method 2 calculation of fuel economy (equation 2) or on the original equation (1).

The Sequence VI Screener Test is the same as the full Sequence VI test except that Run aging stage for the candidate oil is reduced from 31.5 hours at 107° C. with BSFC measured every two hours and six replicate BSFC measurements at 5 minute intervals at the end. Good correlation between the sequence VI screener test and the ASTM sequence VI test has been established.

The results of Sequence VI screener test are shown in Table 1.

TABLE 1

| Component | Example 1 | Comparative Example 2 | Example 3 | Comparative Example 4 |
|---|---|---|---|---|
| SAE Grade | 5W-20 | 5W-20 | 5W-20 | 5W-20 |
| S100N base oil | 80.84[a] | 80.08 | 80.0 | 80.0 |
| Dispersant I[b] | 8.62 | 8.62 | 8.62 | |
| Dispersant II[c] | | | | 8.62 |
| Calcium Salicylate | 2.27 | 3.60 | 2.27 | 2.27 |
| Magnesium Salicylate | 0.57 | | 0.57 | 0.57 |
| Friction Modifier[d] | 0.50 | 0.50 | 1.00 | 1.00 |
| Other Components[e] | 7.20 | 7.20 | 7.84 | 7.84 |
| Boron Concentration[f] | 882 | 896 | 992 | 308 |
| Kinematic Viscosity @ 100° C., cSt | 7.47 | 7.49 | 7.46 | 7.93 |
| Kinematic Viscosity @ | 42.29 | 42.30 | 42.66 | 45.76 |

TABLE 1-continued

| Component | Example 1 | Comparative Example 2 | Example 3 | Comparative Example 4 |
|---|---|---|---|---|
| 40° C., cSt | | | | |
| Cold Cranking Simulator −25° C. (cp) | 2598 | 2831 | 2700 | 3100 |
| Total Base Neutrals (mgKOH/g) | 8.73 | 8.91 | 8.92 | 9 |
| % EFEI (method 2) | 3.67[g] (scr) | 3.47 (scr) | 4.21 | 4.04 |

[a]Wt % based on engine oil
[b]Over borated PIBSA/PAM, boron content 1–1.3%
[c]Borated PIBSA/PAM, boron content 0.35%
[d]Molybdenum $C_8$–$C_{13}$ dialkyl dithiocarbamate
[e]Other components include VI improver, antioxidant, antiwear, corrosion inhibitor, demulsifier and antifoam agents.
[f]ppmw, based on engine oil
[g]sequence VI screener tests was run sequentially on the same Standard deviation under test conditions about ±0.1

Example 1 shows that the combination of Ca plus Mg salicylate provides superior fuel economy over Ca salicylate alone (comparative Example 2). Example 3 demonstrates the further improvement obtained by increasing the boron content of the engine oil over that in Comparative Example 4.

EXAMPLE 5 AND COMPARATIVE EXAMPLE 6

These examples compare the preferred olefinic copolymer VI improver according to the invention with a conventional polymethacrylate VI improver. The Sequence VI Screener Test procedure is described in Example 1. The results are shown in Table 2.

TABLE 2

| Component | Example 5 | Comparative Example 6 |
|---|---|---|
| SAE grade | 10W-30 | 10W-30 |
| S100 N base oil | 81.50[a] | 83.25 |
| Olefin copolymer VI Improver[b] | 5.00 | |
| Polymethacrylate VI Improver[c] | | 3.25 |
| Other components[d] | 13.50 | 13.50 |
| Kinematic Viscosity @ 100° C., cSt | 9.7 | 10.02 |
| Cold Cranking Simulator @ −25° C., cp | 3326 | 3242 |
| HTHS viscosity @ 150° C., cp[e] | 3.02 | 3.03 |
| % EFEI (equation I)[f] | 2.02(scr) | 1.76(scr) |

[a]Wt %, based on engine oil
[b]Ethylene propylene copolymer manufactured by Exxon Chemical Company
[c]Polymethacrylate polymer manufactured by Rohm and Haas
[d]Other components include dispersant, friction modifier, detergent, antioxidant, antiwear, corrosion inhibitor, demulsifier and antifoam
[e]High Temperature High Shear viscosity
[f]See footnote [c] of Table 1.

As shown by comparing Example 5 with comparative Example 6, the preferred olefin copolymer VI improver according to the invention provides greater fuel economy over a typical commercial VI improver.

EXAMPLE 7

A fully formulated engine oil is demonstrated in this example. Fuel economy was measured using the ASTM Sequence VI test described in Example 1 equation 2. The results are given in Table 3.

TABLE 3

| Component | Example 7 |
|---|---|
| SAE grade | 5W-30 |
| S 100 N base oil | 74.50[a] |
| Olefin copolymer[b] | 8.10 |
| Borated dispersant[c] | 10.62 |
| Calcium salicylate[d] | 2.27 |
| Magnesium salicylate[d] | 0.57 |
| Friction modifier[f] | 1.00 |
| Additive package[g] | 2.94 |
| Boron concentration, ppmw[e] | 1360 |
| Calcium concentration, ppmw | 1370 |
| Magnesium concentration, ppmw | 445 |
| Molybdenum concentration, ppmw | 462 |
| Kinematic viscosity at 100° C., cSt | 10.09 |
| Cold cranking simulator at −25° C., cp | 3080 |
| % EFEI (Method 2) | 4.26% |

[a]In Wt % unless otherwise indicated
[b]Olefin copolymer of Example 5
[c]Borated dispersant of Example 3
[d]Example 1
[e]Based on engine oil
[f]Molybdenum dithiocarbamate
[g]Additive package including antioxidant, antiwear, corrosion inhibitor, demulsifier and antifoam This Example shows a high EFEI value of 4.26% in a 5W-30 engine oil. Typical EFEI values of commercially available SAE 5W-30 products are 2.7–3.2%.

EXAMPLE 8

Keeping the same components described in Example 7, formulations A.B, C and D were prepared. These formulations contain the same amount of borated dispersant (6.6% wt), olefinic copolymer (5.1% wt) and other compounds, but differ in the relative amounts of calcium salicylate and magnesium salicylate detergents. Formulations A, B, C and D were subjected to the Ball on Cylinder (BOC) friction test described in the following Example 9. The results given below in Table 4 show that lower friction coefficients are obtained when calcium salicylate and magnesium salicylate are both present as compared to the presence of either calcium salicylate or magnesium salicylate. Lower friction coefficients translate to better fuel economy.

TABLE 4

| Properties | Formulation A | Formulation B | Formulation C | Formulation D |
|---|---|---|---|---|
| Kinematic viscosity @ 100° C. (cSt) | 7.39 | 7.50 | 7.42 | 7.41 |
| Kinematic viscosity @ 40° C., (cSt) | 41.40 | 42.07 | 41.32 | 41.65 |
| Ca concentration (ppm) | 1810 | 25* | 203 | 1620 |
| Mg concentration (ppm) | — | 1740 | 1550 | 192 |
| BOC Friction coefficient | 0.220 | 0.165 | 0.124 | 0.150 |

*from impurities in the Mg salicylate commercial sample

EXAMPLE 9

The fuel economy retention properties of the engine oil in Example 7 are demonstrated in this Example. The oil was tested in a Ford Crown Victoria 4.6L and fuel economy was measured using Federal Test Procedure and Highway Fuel Economy tests. Averages from three repeats as well as standard deviation (% stds) values are reported. The engine oil was aged for 1000 miles and then subjected to the above-cited tests. To assess the oxidative stability of the aged oils the oxidation temperature of the oil using High Pressure Differential Scanning Calorimetry at 500 psi air was measured. Friction properties are measured by the Ball on Cylinder (BOC) friction test using the experimental procedure described by S. Jahanmir and M. Beltzer in ASLE Transactions, Vol. 29, No. 3, p. 425 (1985). A force of 0.8 Newtons (1Kg) is applied to a 12.5 mm steel ball in contact with a rotating steel cylinder that has a 43.9 mm diameter. The cylinder rotates inside a cup containing a sufficient quantity of lubricating oil to cover 2 mm of the bottom of the cylinder. The cylinder is rotated at 0.25 RPM. The friction force is continuously monitored by means of a load transducer. In the tests conducted, friction coefficients attained steady state values after 7 to 10 turns of the cylinder. Friction experiments were conducted with an oil temperature of 104° C. Results are given in Table 5.

TABLE 5

| | Fresh Oil | After 1,000 Miles Highway Driving |
|---|---|---|
| Average weighted FTP fuel economy (miles/gallon) | 19.735 (STDS = 0.0%) | 19.650 (STDS = 0.1%) |
| Average Highway Fuel economy (miles/gallon) | 31.112 (STDS = 0.3%) | 31.262 (STDS = 0.6%) |
| Ball-on-cylinder friction coefficient | 0.11 | 0.11 |
| HPDSC Temperature (°C.) | 247 | 236 |

The data in Table 5 show that the oxidation temperature of the aged oil, as measured by HPDSC was lower than than of the fresh oil, indicating partial oxidation of the sample subjected to highway driving. However, the fuel economy performance of the oil was unchanged upon use. The friction coefficients of the aged oil after the FTP/HWFE tests was also measured in the ball-on-cylinder and compared with that of the fresh oil and the results were identical. This, along with the unchanged fuel economy measured, indicate excellent fuel economy retention of the present engine oil.

I claim:

1. An engine oil for an internal combustion engine having improved fuel economy and fuel economy retention properties comprises:

(a) an oil base stock, (b) at least 2 wt %, based on engine oil, of a boron containing alkenyl succinimide with the proviso that the boron concentration in the engine oil is about 900 to 2000 ppmw, based on engine oil, wherein the ratio of (d) to component (e) is in the range of 8/1 to 1/8, (c) from 50 to 2000 ppmw, based on engine oil, of molybdenum atoms present as molybdenum dithiophosphate or molybdenum dithiocarbamate, (d) from 50 to 4000 ppmw, based on engine oil, of calcium atoms present as calcium salicylate, (e) from 50 to 4000 ppmw, based on engine oil, of magnesium atoms present as magnesium salicylate, and (f) from 0 to 15 wt %, based on engine oil, of a copolymer of ethylene and at least one other alpha-olefin monomer, wherein said copolymer has a molecular weight distribution characterized by at least one of a ratio of $M_w/M_n$ of less than 2 and a ratio of $M_z/M_w$ of less than 1.8, and wherein the copolymer comprises intramolecularly heterogeneous polymeric chains containing at least one crystallizable segment of methylene units and at least one low crystallinity ethylene-alpha-olefin copolymer segment, wherein the crystallizable segment comprises at least about 10 wt % of the copolymer chain and contains as average ethylene content of at least about 57 wt %, wherein the low crystallinity segment contains an average ethylene content of from about 20 to 53 wt %, and wherein at least two portions of an individual intramolecularly heterogeneous chain, each portion comprising at least 5 wt % of said chain, differ in composition from one another by at least 7 wt % ethylene.

2. The engine oil of claim 1 wherein the copolymer has an intermolecular compositional dispersity such that 95 wt % of copolymer chains have a composition 15 wt % or less different from the average ethylene composition.

3. The engine oil of claim 1 wherein the copolymer has a molecular weight distribution characterized by a $M_w/M_n$ and a $M_z/M_w$ ratio less than about 1.5.

4. The engine oil of claim 1 wherein the copolymer has a weight-average molecular weight of 20,000 to 1,000,000.

5. The copolymer of claim 4 wherein the weight-average molecular weight is from 50,000 to 500,000.

6. The engine oil of claim 1 wherein the polyalkenyl succinimide is a polyisobutenyl succinimide.

7. The engine oil of claim 1 wherein component (b) is molybdenum dithiocarbamate.

8. A method for improving the fuel economy and fuel retention performance of an internal combustion engine which comprises operating the engine with the engine oil of claim 1.

9. The engine oil claim 6 wherein component (b) is molybdenum dithiocarbamate.

* * * * *